US008136298B1

(12) United States Patent
Johnston

(10) Patent No.: US 8,136,298 B1
(45) Date of Patent: Mar. 20, 2012

(54) BAHAMA AWNING HURRICANE SHUTTER

(75) Inventor: Thomas B. Johnston, Lakeworth, FL (US)

(73) Assignee: American Builders & Contractors Supply Co., Inc., Beloit, WI (US)

( * ) Notice: Subject to any disclaimer, the term of this patent is extended or adjusted under 35 U.S.C. 154(b) by 958 days.

(21) Appl. No.: 11/879,930

(22) Filed: Jul. 19, 2007

Related U.S. Application Data

(63) Continuation-in-part of application No. 10/616,186, filed on Jul. 9, 2003, now abandoned.

(51) Int. Cl.
*E06B 7/08* (2006.01)

(52) U.S. Cl. ..... 49/64; 49/67; 49/74.1; 52/202

(58) Field of Classification Search ..... 49/61, 63, 49/64, 67, 74.1, 87.1; 52/202, 203
See application file for complete search history.

(56) References Cited

U.S. PATENT DOCUMENTS

| | | | | | |
|---|---|---|---|---|---|
| 103,854 | A * | 6/1870 | Donato | 49/74.1 |
| 163,679 | A * | 5/1875 | Merrill | 49/87.1 |
| 170,789 | A * | 12/1875 | Victor | 160/212 |
| 192,353 | A * | 6/1877 | Smits | 49/74.1 |
| 213,343 | A * | 3/1879 | Morstatt | 49/87.1 |
| 708,618 | A * | 9/1902 | Briggs | 49/87.1 |
| 863,573 | A * | 8/1907 | McCord | 49/74.1 |
| 1,551,753 | A * | 9/1925 | Lane | 49/87.1 |
| 1,571,981 | A * | 2/1926 | Vail | 49/74.1 |
| 1,964,842 | A * | 7/1934 | Bauer | 49/74.1 |
| 2,068,148 | A * | 1/1937 | Moir | 49/77.1 |
| 2,145,569 | A * | 1/1939 | Jones | 49/74.1 |
| 2,164,814 | A * | 7/1939 | Griffith | 49/87.1 |
| 2,291,714 | A * | 8/1942 | Heiser | 49/77.1 |
| 2,457,871 | A * | 1/1949 | Cooper | 49/91.1 |
| 2,490,438 | A * | 12/1949 | Huff | 49/74.1 |
| 2,592,579 | A * | 4/1952 | Kramer | 49/74.1 |
| 2,617,157 | A * | 11/1952 | Olson | 49/74.1 |
| 2,629,145 | A * | 2/1953 | Parsson | 49/74.1 |
| 2,631,341 | A * | 3/1953 | Pettigrew et al. | 49/74.1 |
| 2,742,678 | A * | 4/1956 | De Martin | 49/87.1 |
| 2,770,852 | A * | 11/1956 | Goodwin | 49/74.1 |
| 2,791,008 | A * | 5/1957 | Johnson | 49/86.1 |
| 2,820,259 | A * | 1/1958 | Zveibil | 49/91.1 |
| 3,691,687 | A * | 9/1972 | Economou | 49/74.1 |
| 5,595,536 | A * | 1/1997 | Cornell | 454/78 |
| 5,598,664 | A * | 2/1997 | Grice | 49/74.1 |
| 5,737,874 | A * | 4/1998 | Sipos et al. | 49/67 |
| 5,852,903 | A * | 12/1998 | Astrizky | 52/202 |
| 6,401,391 | B2 * | 6/2002 | Gabriele | 49/87.1 |
| 6,536,174 | B2 * | 3/2003 | Foster et al. | 52/473 |
| 6,604,322 | B2 * | 8/2003 | Horn et al. | 49/64 |
| 6,779,830 | B2 * | 8/2004 | Patberg et al. | 296/146.6 |
| 6,996,934 | B2 * | 2/2006 | Briscoe et al. | 49/67 |
| 2001/0037604 | A1 * | 11/2001 | Gabriele | 49/74.1 |
| 2005/0005523 | A1 * | 1/2005 | Johnston | 49/74.1 |

* cited by examiner

*Primary Examiner* — Gregory J. Strimbu
(74) *Attorney, Agent, or Firm* — Leo Law, LLC; Gerald M. Walsh

(57) ABSTRACT

A Bahama awning-type shutter with functional louvers that is strong enough to withstand all tropical weather and test standards relating to and including hurricane force winds, while incorporating the user-friendly, easy opening mechanism of a jalousie. The opening mechanism is an L-angle structure which is capable of moving all of the louvers in unison, opening them by pulling out on the L-angle and closing them by pushing inward on the L-angle. When the shutter is locked against the structure to which it is attached a portion of the L-angle is positioned between the inner face of the shutter and the structure and cannot move outward, thus locking the louvers in a closed position. In this closed position the louvers have the strength to resist hurricane force winds.

12 Claims, 3 Drawing Sheets

BAHAMA AWNING HURRICANE SHUTTER

CROSS REFERENCE TO RELATED APPLICATIONS

This application is a continuation in part of, and claims the benefit of, U.S. patent application Ser. No. 10/616,186, filed Jul. 9, 2003, now abandoned, which is incorporated herein by reference.

BACKGROUND OF THE INVENTION

1. Field of the Invention

The present invention relates generally to a Bahama awning-type shutter with functional louvers that is strong enough to withstand all tropical weather and test standards relating to and including hurricane force winds, while incorporating the user friendly, easy-opening mechanism of a jalousie, which is capable of moving all of the louvers in unison. This functional louvered Bahama awning-type shutter has the strength to resist hurricane force winds while still allowing the louvers to function.

2. Technical Background

Tropical window coverings, known as Bahama shutters or awnings, are frequently used to provide shade, security and protection from storm damage for windows in homes. Bahama awnings are made up of a framework with a plurality of horizontal louvers or slats, which are usually fixed at a certain angle. The awning attaches to the top of the window frame horizontally by a hinge. The Bahama awning can rotate about the hinge so that the lower portion of the awning can move away from the window. The lower portion of the awning can be held in the open position by telescoping arms. During a storm, the Bahama awning can be lowered to a closed position such that the awning is completely parallel to the window. However, conventional Bahama awnings do not provide adequate protection in a strong tropical event because the protection is structurally limited by the strength of the individual louvers. For hurricane protection, the Bahama awnings must incorporate either a lexan sheet or solid sheet of aluminum to reinforce them for impact resistance.

Jalousie window and door treatments are also well known in tropical climates. Jalousies are typically made up of louvers that extend across and are pivoted in a window frame. To open the louvers, the user actuates an operating mechanism to rotate the louvers outwardly around a horizontal axis. The operating mechanism moves all louvers in unison in the same direction. The louvers are parallel and horizontal when fully open, thereby opening vertical spaces between the louvers for airflow. When closed, the louvers either abut each other or overlap slightly such that upper louvers lap over lower louvers on the outside of the window. Jalousies are used in a variety of locations that may require different needs for ventilation, light transmission, security and appearance. Most often jalousies are used in tropical climates to allow for maximum airflow through the building.

Jalousie window and door treatments generally use a winding crank mechanism to open and close the louvers. The winding crank mechanism uses worm and pinion gears, or the like, whereby the rotation is transformed into translational displacement of a window bar coupled to the louvers. By using the winding crank mechanism, the user can adjust the jalousie's louvers to maintain any desired louver angle. Jalousies may also use a simple bar mechanism which is attached to all the louvers vertically. The bar mechanism is manually operated by a user to move the louvers to any desired position.

It is desirous for Jalousie doors and windows to resist both positive and negative pressures from both inward and outward wind loads. Generally, inward wind loads or positive pressures cause the louvers of the jalousie to close tighter and thus resist inward wind pressure. However, outward wind loads or negative pressures can cause the louvers to open outwardly, resisted only by the frictional resistance of the operating mechanism, which is typically minimal so that the user can easily open the louvers. Thus, the ease with which the louvers open by outward pressure may be a problem during tropical storms or forced entry.

Hurricane winds are the biggest potential problem facing homeowners in tropical climates. Many homeowners use some sort of hurricane shutter to protect their home's windows. Some of the most common hurricane protection products are: hurricane panels, accordion shutters, Bahama awning shutters, colonial hinged hurricane shutters, and roll down hurricane shutters. Southern Building Code Congress International (SBCCI) certification and the Miami-Dade County Building Code product certification are some of the impact certifications that are currently accepted by the Florida Building Code, one of the strongest building codes for wind in the nation. Impact testing standards, such as South Florida Building Code TA 201, 202, 203; SSTDI2; ASTM 1996 and 1886, are used to determine a product's effectiveness against hurricane winds. The "large missile" test is performed by shooting an approximately nine foot long, nine pound 2×4 from an air cannon at 34 mph. This simulates 150 mph wind carrying large debris. Ratings are then given to specify the test load or wind force that the product successfully withstood. These ratings assist the public in making informed decisions about which hurricane protection products they choose for their home.

There is a need to make a Bahama awning-type shutter with functional louvers that is strong enough to withstand all tropical weather, including hurricane force winds, while incorporating the user-friendly, easy-opening mechanism of a jalousie, which is capable of moving all of the louvers in unison.

A reinforced storm shutter as described in U.S. Pat. No. 6,536,174 to Foster et al. ('174 Patent) is an awning-type shutter that contains louvers that are welded at three distinct locations to increase the strength of the shutter. The louvers are rigidly secured to the side members of the frame. This shutter does not allow for all louvers to move simultaneously with each other.

A reinforced shutter structure as described in U.S. Pat. No. 6,543,188 to Poma et al. ('188 Patent) is an awning-type shutter that contains louvers. To enable the shutter to withstand hurricane force winds, the user must insert a rigid support plate into the shutter at the time of the storm. Similarly, the reinforced shutter structure as described in U.S. Pat. No. 5,907,929 to Poma et al. ('929 Patent) is also an awning-type shutter that contains louvers and a removable rigid support plate. Both of these shutters do not provide a unitary Bahama awning-type shutter that protects against hurricane force winds without the need to insert a support member.

An exterior louvered hurricane window shutter as described in U.S. patent application Ser. No. 09/909,571 to Horn et al. describes a shutter that contains functional louvers, however, an impact resistant member is permanently affixed to the shutter's framework in order for the shutter to be hurricane resistant. Therefore, this shutter does not provide a Bahama awning-type shutter that protects against hurricane force winds without the need for an additional member to protect the louvers.

The operating assembly as described in U.S. Pat. No. 5,907,926 to Sosa ('926 patent) enables relatively heavy jalousie window louvers and associated moving components to be actuated over a tolerable range of actuating forces. Brakes permit the louvers to be held frictionally at any fixed orientation. Additionally, the operating assembly as described in the continuation-in-part patent, U.S. Pat. No. 6,061,962 to Sosa ('962 patent) includes a secondary lock that acts primarily to prevent opening of the louvers in response to negative or outward pressure such as from a heavy storm or force applied by a burglar. However, these operating mechanisms are not designed to be incorporated into hurricane resistant Bahama awning-type shutters.

A jalousie as described in U.S. Pat. No. 6,378,248 to Jordal ('248 patent) provides for dual panels with independent panel movement. This jalousie allows for the front panels to be made of an opaque material, so as to reflect the sun when needed, and the rear panels to be made of transparent glass. Even though such dual pane jalousie panels provide increased strength and protection, the jalousie is not designed to withstand hurricane force winds.

Further, the jalousie as described in U.S. Pat. No. 4,813,183 to Jordal ('183 patent) provides for a dual louver blade jalousie that provides a window which forms a sealed air chamber when the louver blades are closed which is highly resistant to air and water infiltration and which has a high insulation value. Although this jalousie is designed to be resistant to air and water during adverse weather conditions, the jalousie is not designed to be resistant to strong hurricane force winds.

A jalousie as described in U.S. Pat. No. 6,098,339 to Rivera et al. 0339) provides for a reinforced jalousie window with spaced wall side jambs for pivot support. This jalousie construction allows for improved air sealing and improved security from unwanted entry. Even though this jalousie offers greater structural strength, the jalousie is not designed to be resistant to hurricane force winds.

Consequently, there is a need in the art for a Bahama awning-type shutter with functional louvers that is strong enough to withstand all tropical weather, including hurricane force winds, while incorporating the user-friendly, easy-opening mechanism of a jalousie, which is capable of moving all of the louvers in unison.

SUMMARY OF THE INVENTION

The present invention solves significant problems in the art by providing a Bahama awning-type shutter with functional louvers that is strong enough to withstand all tropical weather, including hurricane force winds, while incorporating the user-friendly, easy-opening mechanism of a jalousie, which is capable of moving all of the louvers in unison and locking them in a closed position.

Accordingly, it is an object of the present invention to provide a shutter for protecting external openings in a structure from hurricane force winds. The shutter has an outer frame formed by a pair of vertical members and a pair of horizontal members connected to each other and defining an interior area. The shutter has at least one hinge, which connects the outer frame of the shutter to a location on the structure adjacent an external opening in the structure. A plurality of functional louvers are movably connected to the outer frame and fill the interior area of the shutter. The outer frame and louvers are made out of materials that are resistant to hurricane force winds. The louvers of the shutter function by a user-actuated operating mechanism, similar to that found in a jalousie, which is, preferably, a L-angle bracket but can be a bar, winding crank, or a simple mechanism found on the backside of the frame. When the L-angle is employed, the user simply pulls the L-angle outward or pushes the L-angle inward which thereby opens or closes, respectively, all the louvers in unison. The shutter includes means to lock the shutter against the structure, protecting the window from hurricane force winds or intruders. The L-angle provides a means for locking the louvers in the closed position during a storm when the shutter is locked against the structure, thereby preventing the L-angle from moving outward and the louvers from opening. The shutter is movable about the hinge that connects the shutter to the structure and includes a telescoping arm to hold the shutter apart from the structure.

An advantage of the invention is that the Bahama awning-type shutter contains louvers that remain completely functional, while providing protection from hurricane force winds. Additionally, the louvers function in unison with an easy opening mechanism, similar to the mechanisms used on jalousie windows. This allows the user of the shutter to be able to easily open the louvers to vary the amount of light or air entering the building.

DETAILED DESCRIPTION OF THE PREFERRED EMBODIMENT

Figure 1:
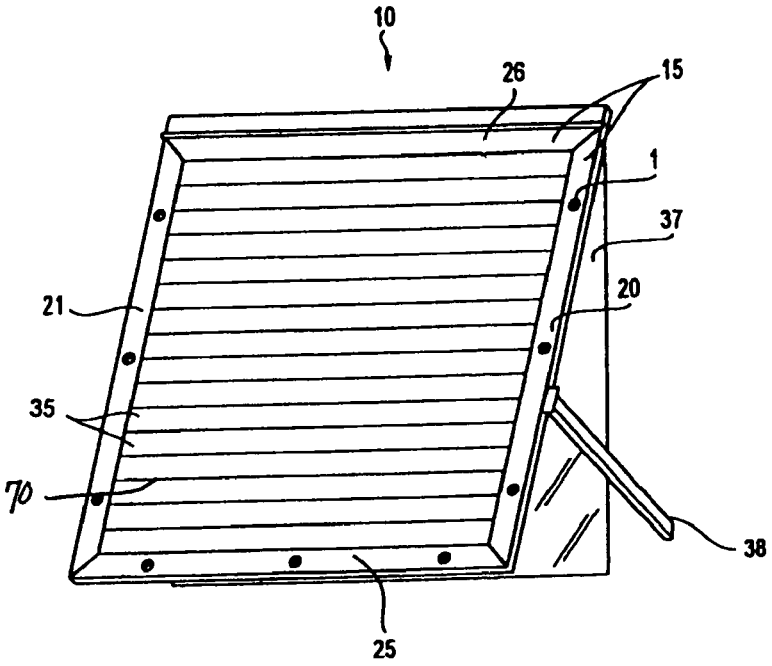
FIG. 1 is a front view of the shutter according to the invention

This invention provides a Bahama awning-type shutter with functional louvers that is strong enough to withstand all tropical weather, including hurricane force winds, while incorporating the user-friendly, easy-opening mechanism of a jalousie, which is capable of moving all of the louvers in unison. While the invention is susceptible of several embodiments, there is shown in the drawings, a specific embodiment thereof, with the understanding that the present disclosure is to be considered as an exemplification of the invention and is not intended to limit the invention to the specific embodiment.

Referring initially to FIG. 1 of the drawings, in which like numerals indicate like elements throughout the several views, an overview of the Bahama awning-type shutter 10 is shown. The Bahama awning-type shutter 10 has an outer frame 15 formed by a pair of vertical members 20 and 21 spaced apart from each other and a pair of horizontal members 25 and 26 spaced apart from each other, where the vertical members 20 and 21 and horizontal members 25 and 26 are connected to each other and define an interior area. The vertical members include a left vertical member 21 and a right vertical member 20. The horizontal members include an upper horizontal member 26 and a lower horizontal member 25. The interior area of the shutter 10 is filled with a plurality of functional horizontal louvers 35 movably connected to the outer frame 15. The louvers 35 are connected to the outer frame 15 by screws, whereby the louvers 35 pivot about the screws. Louvers 35 have an outer edge 70 which faces away from the structure to which the shutter 10 is attached. Both the outer frame 15 and the louvers 35 are made out of hurricane resistant materials. The hurricane resistant materials can be aluminum, polycarbonate, high density plastic with foam reinforcement or other materials with similar strength.

Figure 2:
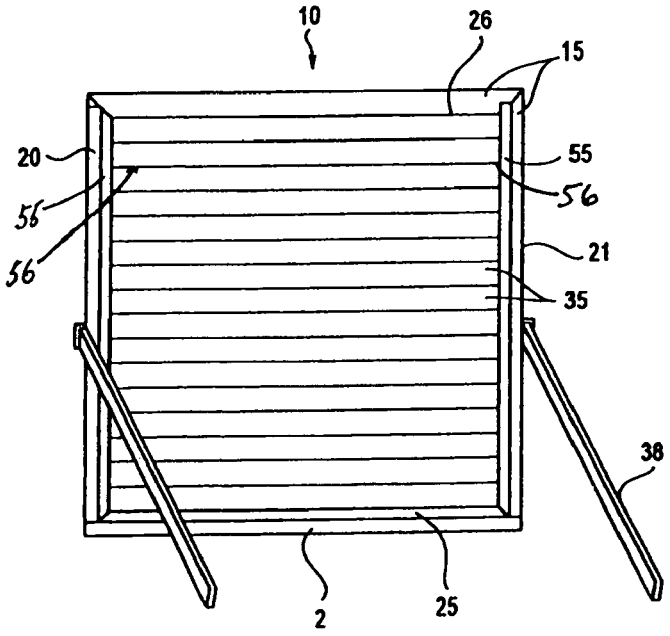
FIG. 2 is a back view of the shutter according to the invention

Shutters 10 are connected by a hinge 36 to the surface above an external opening in a structure. Typically, the shutters 10 are connected by a hinge 36 that attaches the outer frame 15 to just above the opening of the window 37. The shutter 10 is movably connected to the hinge 36 such that the lower portion of the shutter 10 may be moved apart from the structure in an arc relative to the hinge 36, thus becoming a type of awning. The shutter 10 usually overlaps the window 37 on all sides in order to provide adequate protection to the window 37. The shutter 10 has an outer surface which faces away from the structure and an inner surface which faces towards the structure. The shutter 10 can be positioned at some desired angle relative to the window 37. The shutter 10 may be propped open from the bottom or side by use of a telescoping arm 38 or another similar support device attached to the inner surface or backside of shutter 10 to hold the shutter 10 apart from the structure. When the shutter 10 is propped open, light and air are able to enter the building. Thus, the Bahama awning-type shutters 10 of this invention allow light and air to enter a building by two ways, one way is through the louvers 35 when they are open and the second way is through the bottom or sides of the awning when it is propped open and away from the structure Referring to FIG. 1 and FIG. 2, the shutter 10 also contains a means to hold the shutter 10 against the window 37 in a closed position. The means used to hold the shutter 10 against the structure over the window 37 may be an L-shaped bracket at the bottom of the shutter 10, a Z bar 2 extending horizontally across the backside of the shutter 10, predrilled holes 1 through the outer frame 15 which are anchored by bolts to the structure near the window 37, a separate bracket on the wall, or spring loaded arms on the shutter 10 that fit into predrilled holes in the structure near the window 37. The means used to hold the shutter 10 against the structure allows for protection of the window 37 from wind damage or intruders and prevent the L-angle from moving outward, thus locking the louvers closed. Louvers 35 have an inner edge 56 which faces towards the structure to which the shutter 10 is attached.

Figure 3:
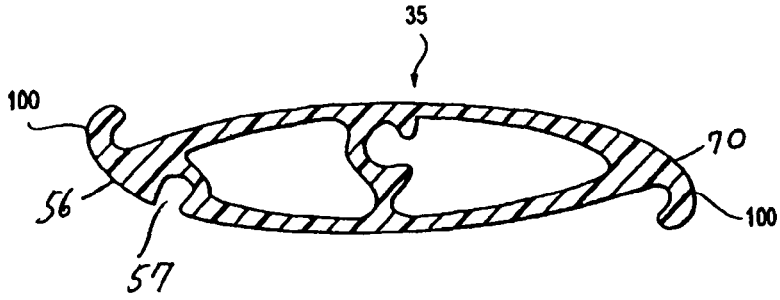
FIG. 3 is a cross view of the louver according to the invention
Figure 4:
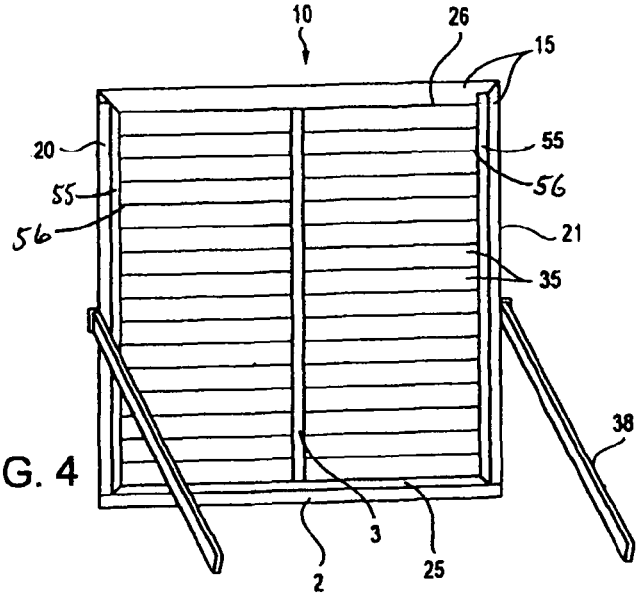
FIG. 4 shows a bar extending vertically across the louvers
Figure 5:
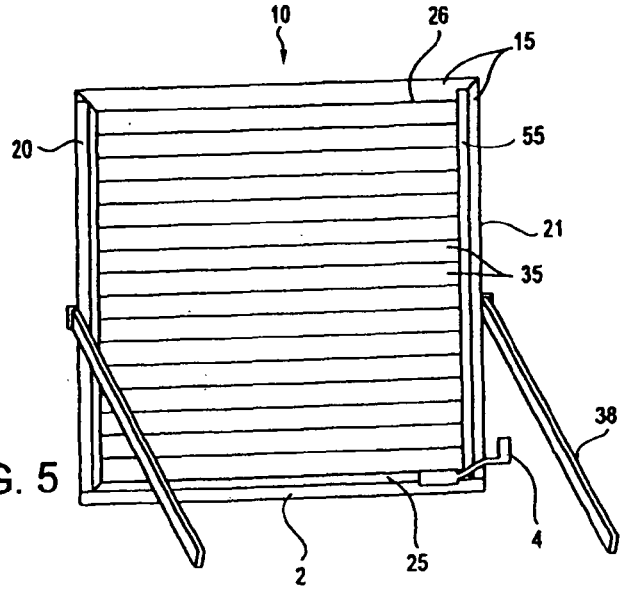
FIG. 5 shows a winding crank to operate the louvers

As shown in FIG. 3, the louvers 35 are also designed to interlock with each other in a completely closed position. The louvers 35 interlock by use of a special hook 100 found on opposite edges of each louvers 35 blade's horizontal edge. Viewed as a cross section the louvers 35 are essentially an elliptical shape with a hook 100 at each edge 56 and 70 facing the opposite direction. L-angle bracket 55 is attached rotatably at the ends of the inner edges 56 by means of opening 57 of louver 35 near the inner surface of shutter 10. When the louvers 35 are closed, the hooks 100 of adjacent louver 35 blades interface such that each louver 35 grasps the louver 35 above and below it. When the louvers 35 are locked in the closed position during a storm, the integrity of the structure of the shutter 10 will be increased by the hook interlocking mechanism 100, and the means used to secure the shutter 10 to the structure. The locked louvers 35 will resist outward wind loads caused by storms or hurricanes, and the interlocking mechanism 100, the L-angle 55, and the means used to secure the shutter 10 to the structure will prevent the louvers 35 from opening.

Referring to FIG. 1, FIG. 2, FIG. 4 and FIG. 5 in combination, the louvers 35 of the shutter 10 function by a user-actuated operating mechanism, similar to that found in a jalousie. Generally, jalousie operating mechanisms are manually raised or lowered vertically within the interior of the shutter to open or close the louvers 35 as required. The operating mechanism of the present invention is connected to all the louvers and opens the louvers by being pulled outward from the inner surface or backside of shutter 10. The operating mechanism may be a L-angle 55, a bar 3, a winding crank 4, or any other operating mechanism that moves all louvers in unison. The horizontal sliding operating mechanism is connected to the louvers 35 and in turn opens or closes all the louvers 35 in unison. When the louvers 35 are in a closed position, a portion of the operating mechanism remains outside of the interior of the shutter 10 and engages the inner surface of the shutter 10 when the louvers are closed. When the L-angle 55 is employed, the user is able to actuate the louvers 35 by moving the L-angle 55 outward to open the louvers 35 and moving the L-angle 55 inwards to close the louvers 35. The L-angle 55 is typically a one-inch by one-inch piece or bracket in the form of the letter "L". The L-angle 55 can act as a spacer between the inner surface of shutter 10 and the structure or window 37 to which it is attached and can be used to lock the louvers 35 in a closed position when the shutter 10 is locked over the window 37. The louvers 35 may be opened by manually adjusting one louver 35. When pulling the L-angle 55 outward by rotating one louver 35 open, the other louvers 35 will move in unison with the louver 35 that is being manually moved. Typically, two L-angles 55 are employed per shutter 10, one L angle 55 being placed next to the ends of louvers 35 and attached rotatably to the inner edge 56 of louver 35. The various embodiments of the operating mechanisms that can be used are all intended to move all of the louvers 35 in unison in the same direction. Thus the louvers 35 can easily be opened or closed, depending on whether the user wants to receive light or air inside the building.

The shutters 10 lock the louvers 35 in the closed position during a storm. When the L-angle 55 is used as the operating mechanism of the louvers 35, the L-angle 55 holds the louvers 35 closed when the shutter 10 is locked against the window 37. When the louvers 35 are in a closed position and the shutter 10 is rotated toward the window 37, the L-angle 55 will automatically be positioned between the window 37 and the shutter 10, thereby preventing the L-angle 55 from moving outward. If the L-angle 55 cannot move outward, the louvers cannot open. Thus, the user can simply secure the shutter 10 to the window 37, or the structure containing the window 37, and the louvers 35 and the shutter 10 will remain in the closed position.

Figure 6:
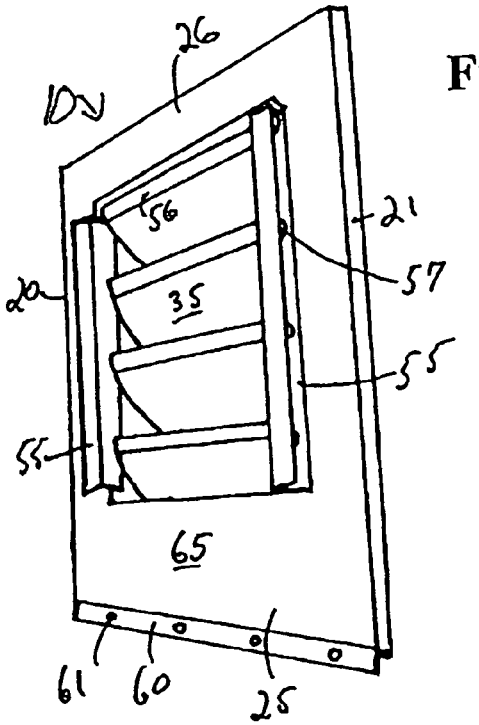
FIG. 6 is a perspective view of the inside surface of the shutter with the louvers in an open position.

FIG. 6 shows a perspective view of shutter 10 from the inner surface 65 which faces the window 37 and/or structure to which shutter 10 is attached or hinged. The shutter 10 is in the open position with the louvers 35 opened. L-angle brackets 55 are shown attached to the sides of the inner edges 56 of louvers 35. The L-angles 55 are fastened rotatably to the louvers 35 by means of openings 57 in the louvers. L-angle 55 is shown pulled outward to maintain the louvers 35 opened. A L-angle bracket 60 is attached at the bottom of shutter 10 for fastening or locking shutter 10 to the window 37, or structure to which it is hinged, by means of holes 61 in bracket 60.

Figure 7:
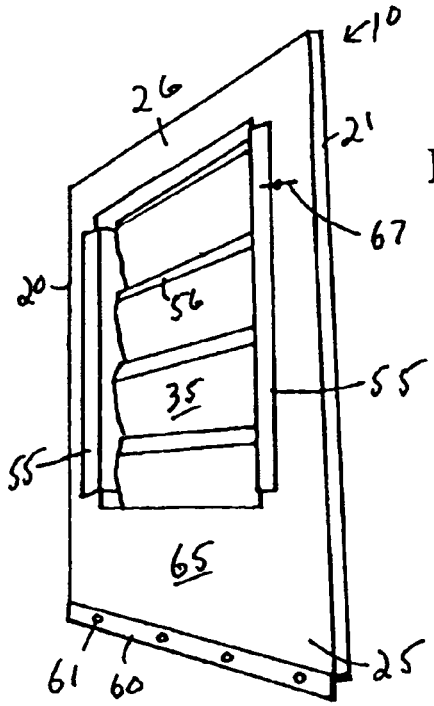
FIG. 7 is a perspective view of the inside surface of the shutter with the louvers in a closed position.

FIG. 7 shows a perspective view of shutter 10 similar to that of FIG. 6 but with the shutter 10 in a closed position with the louvers 35 closed against each other. L-angle 55 is pushed into the interior of shutter 10 and its external portion is flat against the inner surface 65. A lock mechanism 67 can be used to hold the exterior portion of L-angle 55 against the inner surface 65 to prevent the louvers 35 from opening.

Figure 8:
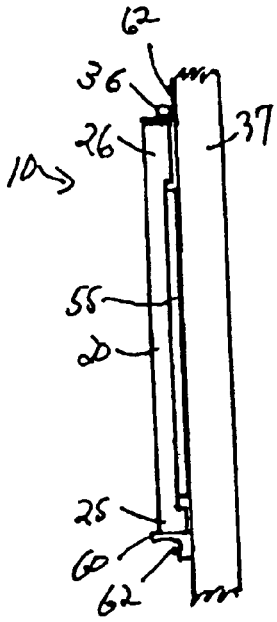
FIG. 8 is a cross view of the shutter attached to a window, showing the L-angle sandwiched between the shutter and the window.

FIG. 8 shows a cross view of the shutter 10 attached to a window 37 (or the structure containing window 37). Shutter 10 is attached by a hinge 63 at the top of window 37 using bolts 62. Shutter 10 can also be locked or fastened to window 37 (or the structure containing window 37) at the bottom edge of shutter 10 using L-angle bracket 60 and bolts 62 inserted through holes 61. The external portion of L-angle 55 is sandwiched or spaced between window frame 37 and the inner surface 65 of shutter 10 so that L-angle 55 cannot move outward. Louvers 35 are, thus, closed in a fully and securely locked position when L-angle 55 is sandwiched in this manner.

Accordingly, it will be understood that the preferred embodiment of the present invention has been disclosed by way of example and that other modifications and alterations may occur to those skilled in the art without departing from the scope and spirit of the appended claims. Those skilled in the art will understand that this invention could be used in various ways to build hurricane resistant shutters with functional louvers. For example, a Bahama awning-type shutter could be made to include a mullion in the middle of the louvers. Thus, both sides of shutter would contain independently functioning louvers, while still retaining hurricane resistance. Any number of mullions could be added to the Bahama awning-type shutter of this invention in order to extend the length of the shutter, while still retaining the functioning louvers of this invention. Only one L-angle 55 can be used on the shutter if desired. L-angle 55 can have other shapes in addition to an L shape and still function to lock louvers 35 in a closed position.

It will be understood that various changes in the details, materials, and arrangements of the parts which have been described and illustrated above in order to explain the nature of this invention may be made by those skilled in the art without departing from the principle and scope of the invention as described herein and as recited in the attached claims.

The invention claimed is:

1. A shutter attached to a structure over an opening in the structure, comprising:

a) a frame formed by a pair of vertical members and a pair of horizontal members connected to each other and defining an interior area, wherein said pair of horizontal members includes an upper horizontal member and a lower horizontal member, said upper horizontal member having a hinge and said shutter being rotatable about said hinge between an open position and a closed position relative to said structure, wherein said shutter covers the opening in the structure and said frame overlaps the structure on at least one side of the opening when said shutter is in said closed position, and wherein said hinge is attached to the structure above the opening;

b) said vertical members of said frame having an exterior which is outside said interior area, said exterior of said vertical members having an inner surface facing towards the structure;

c) a plurality of functional horizontal louvers rotatably connected to said frame and substantially filling said interior area of said frame, wherein said louvers are moveable between an opened position and in a closed position, and wherein said louvers have an inner edge facing the structure;

d) an operating mechanism having a first portion and a second portion, said first portion mounted to said louvers at said inner edge of said louvers to move said louvers to said opened position as said operating mechanism is pulled away from said inner surface of said vertical members and to move said louvers to said closed position as said operating mechanism is pushed towards said inner surface of said vertical members, wherein said first portion of said operating mechanism remains within said interior area of said frame when said louvers are in said closed position; and e) said second portion of said operating mechanism 1) remaining outside said frame when said louvers are in said closed position, 2) extending away from said first portion of said operating mechanism and extending towards one of said vertical members of said frame, and 3) overlapping said inner surface of said one of said vertical members in a direction generally perpendicular to said inner surface of said one of said vertical members, wherein said second portion of said operating mechanism is disposed between said inner surface of said one of said vertical members and the structure on the at least one side of the opening such that the structure on said at least one side of the opening prevents said operating mechanism from moving away from said inner surface of said vertical members when said shutter is in said closed position.

2. The shutter of claim 1 further comprising an L-shaped bracket or Z-bar on the lower horizontal member for reversibly fastening said lower horizontal member against the structure, thereby holding said shutter in said closed position.

3. The shutter of claim 1 further comprising a telescoping arm for holding said shutter in said open position.

4. The shutter of claim 1 wherein said operating mechanism is an L-angle bracket wherein one leg of said L-angle bracket is said first portion of said operating mechanism and wherein the other leg of said L-angle bracket is said second portion of said operating mechanism.

5. The shutter of claim 1 wherein said louvers have hooks so that said louvers are able to interlock with each other when said louvers are in said closed position.

6. The shutter of claim 1 wherein said shutter is composed of aluminum, polycarbonate, or high density plastic with foam reinforcement, or combinations thereof.

7. A shutter attached to a structure over an opening in the structure, comprising:

a) a frame formed by a pair of vertical members and a pair of horizontal members connected to each other and defining an interior area, wherein said pair of horizontal members includes an upper horizontal member and a lower horizontal member, said upper horizontal member having a hinge and said shutter being rotatable about said hinge between an open position and a closed position relative to said structure, wherein said shutter covers the opening in the structure and said frame overlaps the structure on at least one side of the opening when said shutter is in said closed position, and wherein said hinge is attached to the structure above the opening;

b) said vertical members of said frame having an exterior which is outside said interior area, said exterior of said vertical members having an inner surface facing towards the structure;

c) a plurality of functional horizontal louvers rotatably connected to said frame and substantially filling said interior area of said frame, wherein said louvers are moveable between an opened position and a closed position, and wherein said louvers have an inner edge facing the structure;

d) an operating mechanism having a first portion and a second portion, said first portion mounted to said louvers at said inner edge of said louvers to move said louvers to said opened position as said operating mechanism is pulled away from said inner surface of said vertical members, and to move said louvers to said closed position as said operating mechanism is pushed towards said inner surface of said vertical members, wherein said first portion of said operating mechanism remains within said interior area of said frame when said louvers are in said closed position;

e) said second portion of said operating mechanism 1) remaining outside said frame when said louvers are in said closed position, 2) extending away from said first portion of said operating mechanism and extending towards one of said vertical members of said frame, and 3) overlapping said inner surface of said one of said vertical members in a direction generally perpendicular to said inner surface of said one of said vertical members, wherein said second portion of said operating mechanism is disposed between said inner surface of said one of said vertical members and the structure on the at least one side of the opening such that the structure on said at least one side of the opening prevents said operating mechanism from moving away from said inner surface of said vertical members when said shutter is in said closed position;

an L-shaped bracket or Z-bar on the lower horizontal member for reversibly fastening said lower horizontal member against the structure, thereby holding said shutter in said closed position and g) a telescoping arm for holding said shutter in said open position.

8. The shutter of claim 7 wherein said operating mechanism is said L-shaped bracket wherein one leg of said L-shaped bracket is said first portion of said operating mechanism and wherein the other leg of said L-shaped bracket is said second portion of said operating mechanism.

9. The shutter of claim 7 wherein said louvers have hooks so that said louvers are able to interlock with each other when said louvers are in said closed position.

10. The shutter of claim 7 wherein said shutter is composed of aluminum, polycarbonate, or high density plastic with foam reinforcement, or combinations thereof.

11. A shutter attached to a structure over an opening in the structure, comprising:

a) a frame formed by a pair of vertical members and a pair of horizontal members connected to each other and defining an interior area, wherein said pair of horizontal members includes an upper horizontal member and a lower horizontal member, said upper horizontal member having a hinge and said shutter being rotatable about said hinge between an open position and a closed position relative to said structure, wherein said shutter covers the opening in the structure and said frame overlaps the structure on at least one side of the opening when said shutter is in said closed position, and wherein said hinge is attached to the structure above the opening;

b) said vertical members of said frame having an exterior which is outside said interior area, said exterior of said vertical members having an inner surface facing towards the structure;

c) a plurality of functional horizontal louvers rotatably connected to said frame and substantially filling said interior area of said frame, wherein said louvers are moveable between an opened position and a closed position, and wherein said louvers have an inner edge facing the structure;

d) an L-angle bracket having a first leg and a second leg, said first leg mounted to said louvers at said inner edge of said louvers to move said louvers to said opened position as said L-angle bracket is pulled away from said inner surface of said vertical members and to move said louvers to said closed position as said L-angle bracket is pushed towards said inner surface of said vertical members, said first leg of said L-angle bracket remains within said interior area of said frame when said louvers are in said closed position e) said second leg of said L-angle bracket 1) remaining outside said frame when said louvers are in said closed position, 2) extending away from said first leg of said L-angle bracket and extending towards one of said vertical members of said frame, and 3) overlapping said inner surface of said one of said vertical members in a direction generally perpendicular to said inner surface of said one of said vertical members, wherein said second leg of said L-angle bracket is disposed between said inner surface of said one of said vertical members and the structure on the at least one side of the opening such that the structure on said at least one side of the opening prevents said L-angle bracket from moving away from said inner surface of said vertical members when said shutter is in said closed position, wherein said louvers have hooks so that said louvers are able to interlock with each other when said louvers are in said closed position;

f) said L-angle bracket is disposed on the lower horizontal member for reversibly fasten said lower horizontal member against the structure, thereby holding said shutter in said closed position; and g) a telescoping arm for holding said shutter in said open position.

12. The shutter of claim 11 wherein said shutter is composed of aluminum, polycarbonate, or high density plastic with foam reinforcement, or combinations thereof.

* * * * *